US005450967A

United States Patent [19]

Mallory

[11] Patent Number: 5,450,967

[45] Date of Patent: Sep. 19, 1995

[54] HAT STAND DISPLAY

[76] Inventor: Ralph Mallory, 18 Cottage St., Belmont, Mass. 02178

[21] Appl. No.: 266,186

[22] Filed: Jun. 27, 1994

Related U.S. Application Data

[63] Continuation-in-part of Ser. No. 179,107, Jan. 10, 1994, abandoned.

[51] Int. Cl.[6] ..... A47F 7/00

[52] U.S. Cl. ..... 211/30; 211/73

[58] Field of Search ..... 211/30, 32, 33, 104, 211/73; 248/174, 459

[56] References Cited

U.S. PATENT DOCUMENTS

| | | | |
|---|---|---|---|
| 406,673 | 7/1889 | Seymour | 211/30 |
| 1,822,297 | 7/1929 | Kemery . | |
| 1,999,968 | 8/1934 | Nickel | 206/44 |
| 2,918,178 | 12/1959 | Leone | 211/178 |
| 3,825,216 | 7/1974 | Rodvien | 248/174 |
| 4,150,752 | 4/1979 | Breining et al. | 211/13 |
| 4,346,825 | 8/1982 | Leger | 223/66 |
| 4,896,820 | 1/1990 | Harrington | 211/73 X |
| 5,190,211 | 3/1993 | Stoddard et al. | 229/121.21 |
| 5,213,220 | 5/1993 | McBride | 211/73 X |

*Primary Examiner*—Ramon O. Ramirez
*Assistant Examiner*—Sarah L. Purol

[57] ABSTRACT

Collapsible hat display stand which is easy to package, easy to carry and easy to assemble, made of a durable and light-weight sheet material, die cut with a preset pattern. Each die cut forms at least one or a series of cross-bars horizontally across the sheet, with an M-shaped peak formed on top of each cross-bar. When the stand is fully deployed, each cross-bar forms a hat pedestal. In a multi-hat embodiment, the sheet is scored along vertical scoring axes to form four vertical panels. The sheet is folded along a central scoring to provide a flat, collapsed workpiece for compact storage and shipping. The stand is assembled from the packaged sheet by rotating out the central panels on either side of the central scoring to subtend therebetween an acute angle while overlapping the end panels which are mated. During this assembly process, each of the cross-bars is automatically folded and bowed along the central scoring for forming the hat pedestals. A graphics panel enables display of favorite artwork along with the hats.

20 Claims, 5 Drawing Sheets

HAT STAND DISPLAY

This application is a continuation-in-part of U.S. patent application Ser. No. 08/179,107, now abandoned filed Jan. 10, 1994, attorney docket number RM001, incorporated herein by reference.

BACKGROUND OF THE INVENTION

The present invention relates to hat display stands, and more particularly, to a durable and easily deployed hat display stand.

Sports paraphernalia, such as baseball cards, football banners and team hats, perhaps weighing several ounces but under a pound, are now collected in large numbers by many sports enthusiasts. For example, it is not unusual for a collector to have many favorite hats in a several collections, segmented by leagues or divisions. In any case, it is desirable to display these hats in a presentable and uniform manner both to facilitate viewing and to maintain the integrity and shape of each displayed hat. Yet display stands tend to be bulky, cumbersome, difficult to package and transport and not designed for consumer home use.

It is therefore an object of the present invention to provide a hat display stand which is easy to package, easy to carry and easy to deploy.

It is another object of the present invention to provide a durable yet light-weight hat stand that is easy to assemble without tools.

It is yet another object of the present invention to provide a hat stand with accompanying display features.

SUMMARY OF THE INVENTION

The present invention is directed to method and apparatus forming a display stand for hats, such as baseball hats. The stand is easy to package, easy to carry and easy to assemble, and is made of a durable and light-weight material, such as cardboard, plastic, light weight metal or the like. In a preferred embodiment of the invention, a hat display stand is formed from a single sheet of corrugated material, such as plastic, which is die cut with a preset pattern. Each die cut forms a series of cross-bars horizontally across the sheet, with a peak (preferably M-shaped) formed on top of each cross-bar. During formation of these peaks material is removed from the sheet to form a plurality of void areas separating each of the cross-bars. When the stand is fully deployed, the cross-bars form a plurality of hat pedestals.

The hat stand display is preferably rendered collapsible by a convenient and cost-effective arrangement. Preferably the sheet is scored along vertical scoring axes to form several panels. This scoring trains the sheet to fold in a desired configuration. The sheet is folded along a central score to provide a flat, collapsed workpiece for compact storage and shipping. (The term "score" or "scoring" will be appreciated to encompass the concepts of indenting, impressing, cutting or otherwise configuring the material to facilitate folding.)

The collapsible stand is assembled from the packaged sheet by rotating out the panels on either side of the central scoring to subtend therebetween an angle of about 30 degrees while overlapping the ends of the panels. During this assembly, an adhesive or locking tab or tabs are utilized on the side panels, such that once the side panels are overlapped together in correct position, the adhesive or locking tab(s) will sustain the stand and an assembled structure.

During this assembly process, the cross-bars are automatically folded and bowed along the central scoring for forming the plurality of hat pedestals. This folding of cross-bars forms each hat pedestal with a pair of vertical uprights arising from a pair of support beams which extend out from the side panels. The height and length of the uprights and beams is selected so as to be able to support the hats without deformation of the sheet material. In the preferred embodiment, these dimensions enable a conventional sports hat to be placed over the hat pedestal and to be supported thereby, with the bill and logo end of the hat facing forward and the hat remaining in its natural shape. The front of each upright is formed having a beveled edge, which enables the hats to be tilted with a forward downward pitch if desired. Providing this pitch option enables display of the hats in a pleasing manner.

Another embodiment of the invention includes using a material sheet having at least one horizontal cross-bar. This cross-bar has a top surface defining a peak, and further has an arrangement defining vertical axes for dividing the sheet vertically and forming vertical panels including side panels and at least one central panel. These axes enable folding the sheet in a desired configuration until the side panels overlap to form a hat pedestal defined by the cross-bar.

In a further embodiment of the invention, the above hat stand display is provided with a graphics panel for display of artwork. This artwork may take the form of printed team decals, or pictures or drawings of favorite sports figures, and may include a mounting arrangement to facilitate attachment of one's own favorite pictures.

BRIEF DESCRIPTION OF THE DRAWINGS

These and other features and advantages of the present invention will be more fully understood by reference to the following detailed description in conjunction with the attached drawing in which like reference numerals refer to like elements and in which.

DETAILED DESCRIPTION

Figure 1:
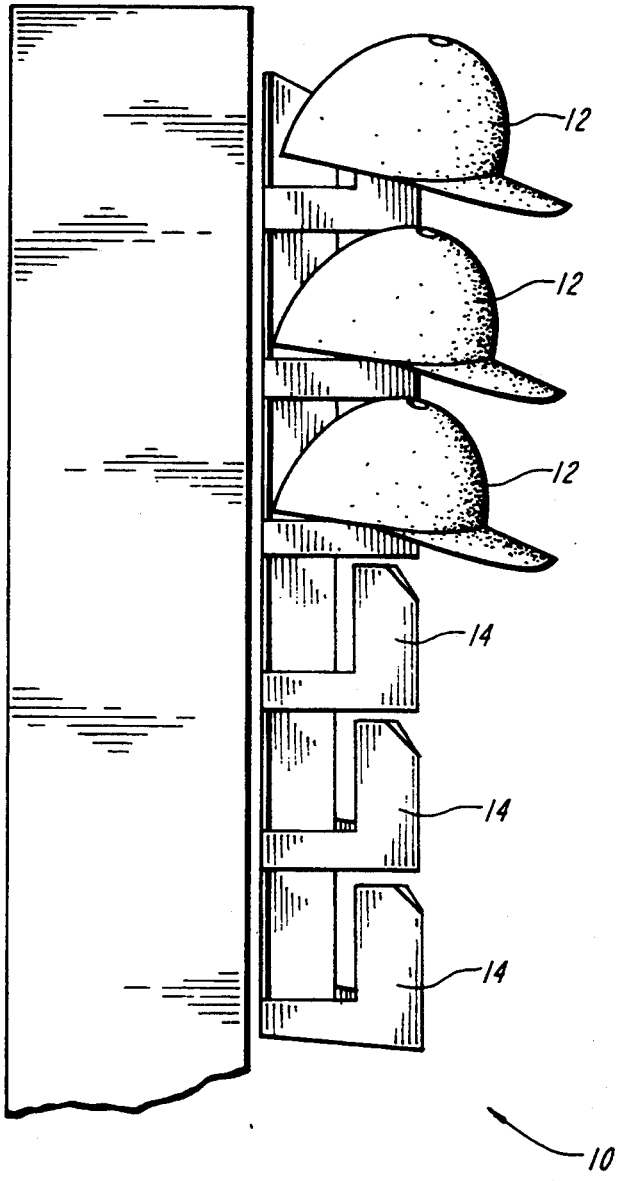
FIG. 1 is a left side perspective view of an assembled hat display stand according to the invention, mounted on a wall.

FIG. 1 shows a preferred assembled hat display stand 10 according to the invention mounted to a support structure, such as a wall, and having a plurality of hats 12 individually displayed on a respective hat pedestal 14.

Figure 2:
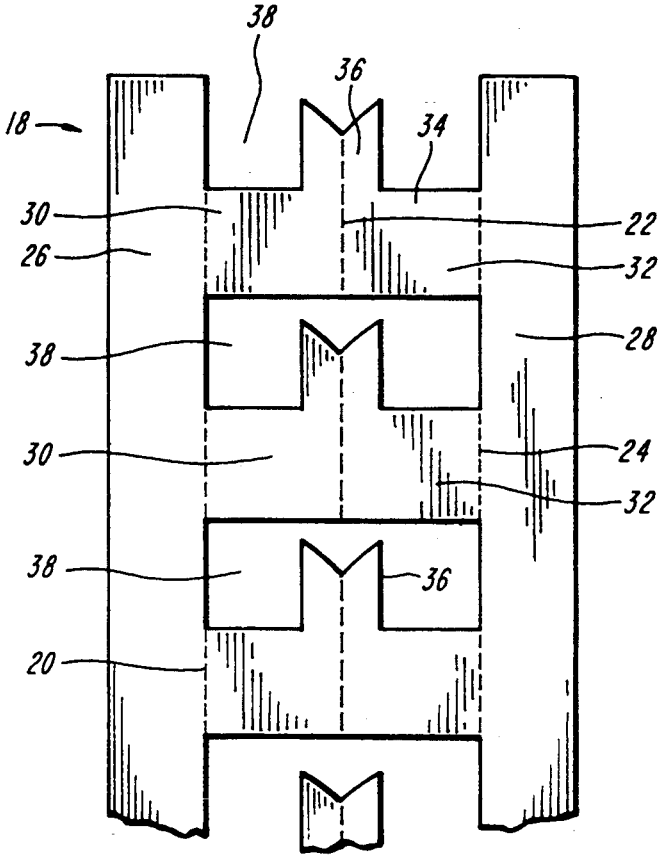
FIG. 2 is a (partial) front or rear view of a cut sheet according to the invention.

A preferred hat stand 10 is assembled from a single, pre-cut sheet of material 18, as shown in the partial view of FIG. 2. This material is preferably light-weight yet structurally robust, such as corrugated cardboard, a plastic or metal. In the six-hat embodiment shown in FIG. 1, the sheet is 22 inches wide by 36 inches high. However, other vertically or horizontally oriented multiple embodiments or even a single hat embodiment, of differing sizes, are also within the scope of the invention. (Preferably, each sheet has the same surface finish on its front and back sides, so that FIG. 2 will be appreciated to be either a front or back view.)

Figure 3:
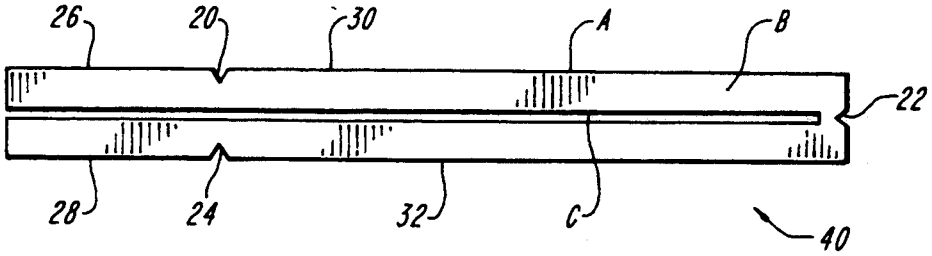
FIG. 3 is an end view of the cut sheet of FIG. 2 folded in half.
Figure 4:
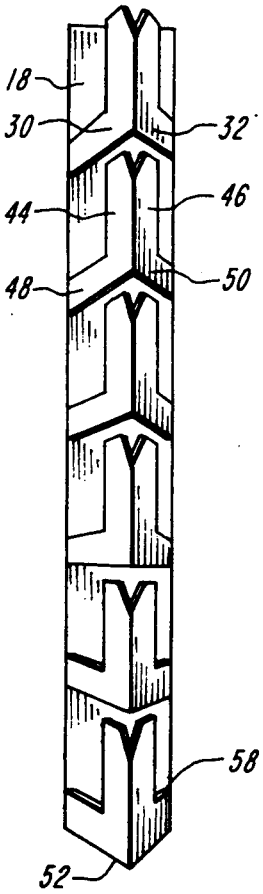
FIG. 4 is a front perspective view of the stand of FIG. 1.
Figure 5:
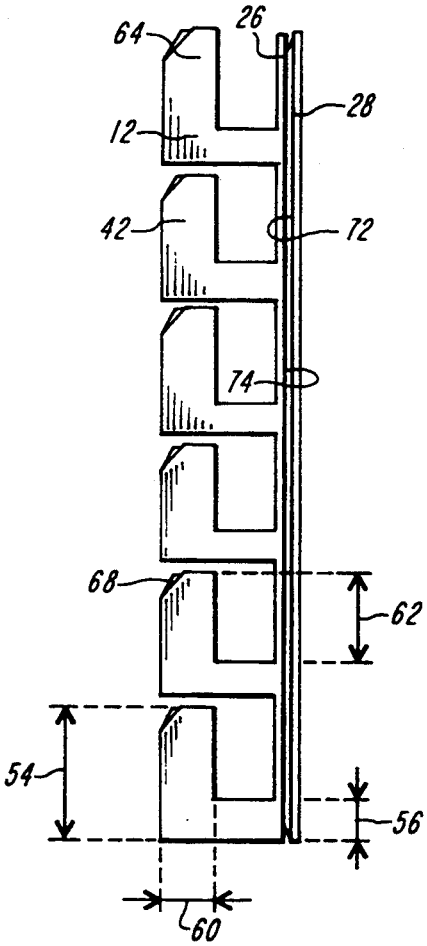
FIG. 5 is a right side view of the stand of FIG. 1.
Figure 6:
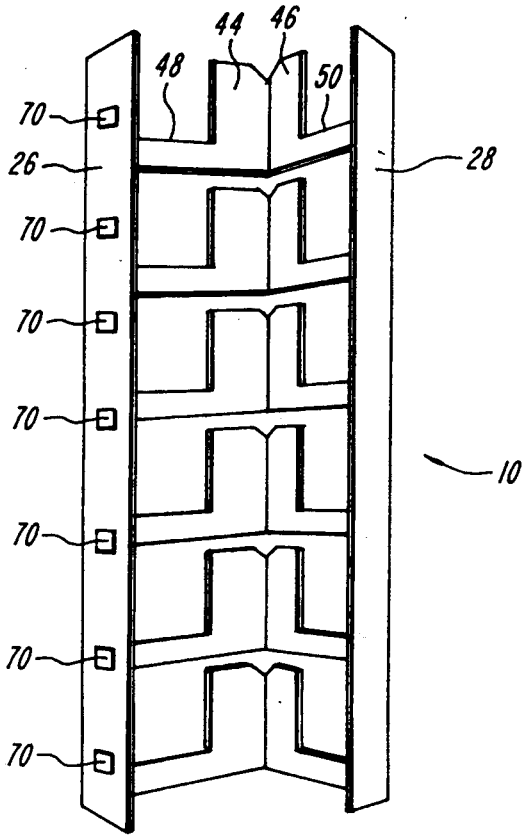
FIG. 6 is a rear perspective view of the sheet of FIG. 2 partially folded to form the stand of FIG. 1.
Figure 7:
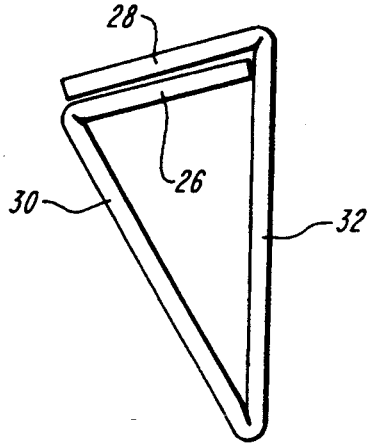
FIG. 7 is a top view of the assembled stand of FIG. 1.

Each sheet 18 is scored along vertical scoring axes 20, 22 and 24 to form four vertical panels, namely, four inch side panels 26, 28 and about seven inch central panels 30, 32. This scoring 20, 22, 24 trains the sheet to fold in a desired configuration. As shown in FIG. 3, sheet 18 is folded along central scoring axis 22 to provide the flat, collapsed workpiece 40 for compact storage and shipping. Each score 20, 22, 24 can be formed in a conventional manner, depending upon the material, for example, forming scorings at top surface A of the sheet and penetrating toward the sheet interior B, but not penetrating to the opposite side surface C of the sheet.

Returning to FIG. 2, it will be appreciated that sheet 18 is die cut to form a series of about seven inch cross-bars 34, each with an M-shaped peak 36 formed on top of each cross-bar. During formation of these peaks 36, material is removed from sheet 18, and this removal forms a plurality of void areas 38 above each of the cross-bars.

With Reference to FIGS. 4–7, it will be appreciated that stand 10 is relatively easy to assemble from the packaged sheet 40, by simply rotating out central panels 30, 32 to subtend therebetween an angle of about 30 degrees while overlapping the end panels 26, 28. During this process, the cross-bars 30 are automatically folded along the central scoring 22 for forming the plurality of hat pedestals 14. This folding of cross-bars 30 forms each hat pedestal 14 with a pair of vertical uprights 44, 46 arising from a pair of support beams 48, 50 which extend out from side panels 26, 28, respectively.

The height and length of the beams and uprights is selected so as to be able to support the hats 12 without deformation thereof. For conventional baseball caps, the hat pedestal beams extend from scorings 20, 24 along each beam bottom horizontal surface 52 about 6–7 inches, and along each upright outside vertical surface 54 about 6–7 inches. The internal beam height 56 from its bottom 52 to its top horizontal beam surface 58 is about two inches. The upright width 60 is about three inches. The upright height 62 from the beam top surface 58 to the top 64 of each peak 36 is about four inches. The front of each upright 14 is formed having a beveled edge 68.

Each hat 12 is intended to rest upon the top surface 64 of the peak 36 of a pedestal 12, with the back of the hat resting on the beam top surface 58. This configuration enables a conventional hat to be placed over the hat pedestal and to be supported thereby. The beveled edge 68 enables seating of the hats with the bill end of the hat pitching forward downwardly at a slight angle.

Figure 8:
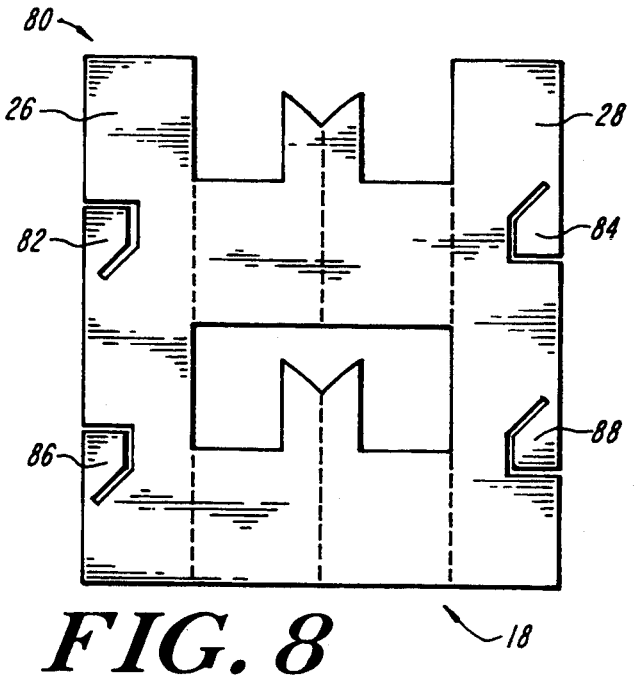
FIG. 8 is a front view of an alternative hat display stand according to the invention.

During assembly of stand 10, either an adhesive 70 is applied to either of the mating surfaces 72, 74 of side panels 26, 28, and the side panels are then overlapped in correct position and pressed together. Alternatively, as shown in the two pedestal configuration 80 of FIG. 8, mating tab pairs 82, 84 and 88, 86 are cut into the edges of sheet 18 so that the side panels 26, 28 can be mated by locking of the respective mating. In any event, the invention is configured to maintain its assembled arrangement, and as such can provide a robust and rigid hat stand structure.

Figure 9:
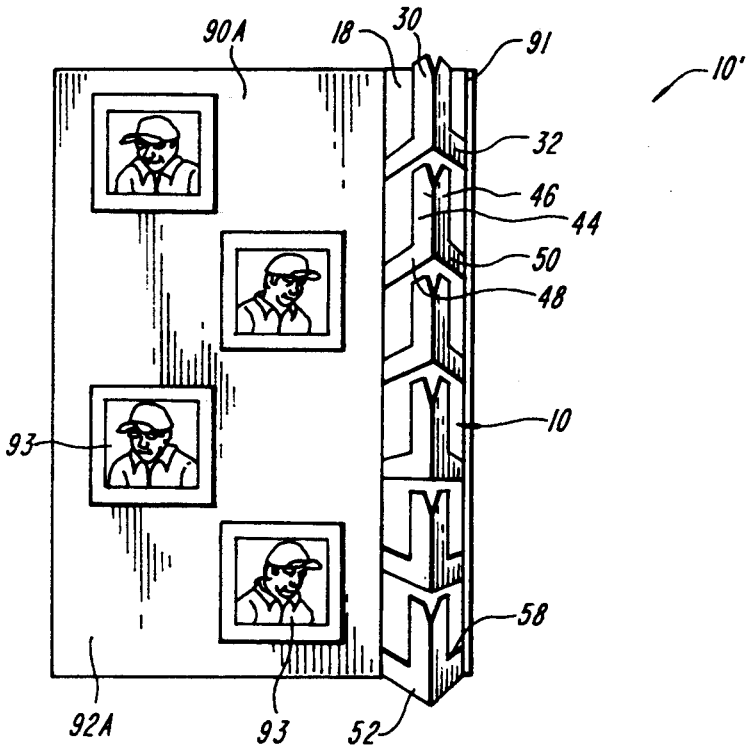
FIG. 9 is a front view of an alternative hat display stand according to the invention.
Figure 10:
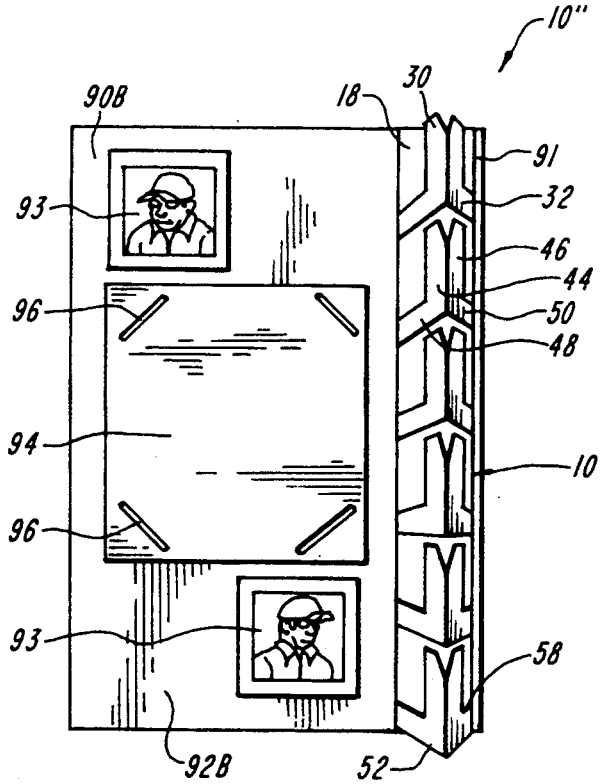
FIG. 10 is a front view of an alternative hat display stand according to the invention.

Alternative preferred embodiments of the invention are shown in FIGS. 9 and 10, where stands 10' and 10'' are formed by mounting of stand 10 on top of a graphics panel 90A or 90B. In the embodiment of FIG. 9, panel 90A has a mating portion 91 and a display portion 92A for display of artwork. The display portion 92A is supplied with photographs 93 of favorite players. In the embodiment of FIG. 10, panel 90B has a mating portion 91 and a display portion 92B for display of artwork. Portion 92B is further provided with a pane 94 for attachment of personalized graphics, such as one's own picture. Slots 96 are provided for capture of the corners of the graphic to enable easy and removable attachment thereat.

Stand 10 is mounted to panels 90A or 90B by mating the assembled stand with the mating portion 91 of the panel, and affixing it thereto via tape or glue or other fastening device.

It will be understood that the above description pertains to only several embodiments of the present invention. That is, the description is provided by way of illustration and not by way of limitation. For example, while a vertically upright hat stand has been described in detail, the stand may also be formed as a horizontally oriented unit within the teachings of the invention. The invention is further characterized according to the following claims.

What is claimed is:

1. A hat display stand, comprising a material sheet having at least one horizontal cross-bar, said cross-bar having a top surface defining a peak, further comprising means for folding, said means defining vertical axes, said axes dividing said sheet vertically and forming vertical panels including side panels and at least one central panel, said axes enabling folding said sheet in a desired configuration, said means further for enabling folding of said sheet until said side panels overlap to form a hat pedestal defined by said cross-bar.

2. The stand of claim 1 wherein said means comprises a series of scorings defining said axes, said scorings forming four vertical panels including two side panels and two central panels, and said folding means further comprising means for folding said sheet along a central one of said scorings to provide a flat, collapsed workpiece for compact storage and shipping.

3. The stand of claim 2 wherein said peak is M-shaped and said cross-bar further comprises a pair of uprights and beams, said uprights and beams selected so as to be able to support the weight of a sports hat without substantial deformation of said sheet.

4. The stand of claim 3 further comprising means for pitching said hat forward downwardly at a slight angle.

5. The stand of claim 4 wherein said means for pitching comprising a beveled edge on said uprights.

6. The stand of claim 1 wherein said sheet is about 22 inches wide by 36 inches high and further defines a pair of four inch side panels and a pair of seven inch central panels, said sheet further defining a series of cross-bars horizontally defined across said sheet, each said cross-bar defining thereon an M-shaped peak, and further defining a plurality of void areas separating said cross-bars, whereby folding of said sheet until said side panels overlap forms a plurality of hat pedestals defined by said cross-bars.

7. The stand of claim 1 wherein each said side panel has mating means for mating with each other said side panel.

8. The stand of claim 7 wherein said mating means comprises an adhesive placement area.

9. The stand of claim 7 wherein said mating means comprises cooperating locking tabs.

10. The stand of claim 1 further comprising a graphics panel, having a mating portion and a display portion, said sheet being attachable to said mating portion, said display portion for display of artwork.

11. The stand of claim 10 wherein said display portion has slots for receipt of the corners of a graphic.

12. A collapsible hat display stand, comprising a material sheet having at least one horizontal cross-bar, said cross-bar having a top surface defining a peak, further comprising scoring means defining vertical scoring axes, said scorings dividing said sheet vertically and forming four vertical panels including two side panels and two central panels, said scoring training said sheet to fold in a desired configuration, said means for enabling folding of said sheet until said side panels overlap to form a hat pedestal defined by said cross-bar.

13. The stand of claim 12 further comprising a graphics panel, having a mating portion and a display portion, said sheet being attachable to said mating portion, said display portion for display of artwork.

14. The stand of claim 13 wherein said display portion has slots for receipt of the corners of a graphic.

15. Method of forming a hat stand comprising the steps of cutting into a sheet of material at least one cross-bar horizontally across said sheet, said cross-bar defining thereon a peak formed on the top of said cross-bar, and forming a series of scorings on said sheet along vertical scoring axes, said scorings dividing said sheet vertically and forming vertical panels including side panels and a central panel, said scoring training said sheet to fold in a desired configuration for forming a hat pedestal defined by said cross-bar.

16. The method of claim 15 further comprising the step of forming a vertical central scoring down the center of said central panel, and further comprising the step of folding said sheet in half for flat storage, said folding being done along said central scoring.

17. The method of claim 15 further comprising the step of forming a plurality of said cross-bars and the step of folding said sheet until said side panels overlap to form a plurality of hat pedestals defined by said cross-bars, each said cross-bar having an M-shaped peak.

18. The method of claim 17 wherein said forming a series of scorings further includes forming end panels, and further comprising the step of assembling the stand from said sheet by rotating out said side panels on either side of said central panel to subtend therebetween an acute angle while overlapping said end panels.

19. The method of claim 18 further comprising the step of joining mating surfaces of said overlapping panels, such as by adhesive or interlocking tabs.

20. The method of claim 17 further comprising the step of forming a vertical central scoring down the center of said central panel, and further comprising the step of folding and bowing said cross-bars along said central scoring for forming a plurality of hat pedestals.

* * * * *